US010399717B2

(12) United States Patent
Chubb et al.

(10) Patent No.: US 10,399,717 B2
(45) Date of Patent: Sep. 3, 2019

(54) DOOR ASSEMBLY PACKAGING

(71) Applicant: Thermoseal Industries, LLC, Gloucester City, NJ (US)

(72) Inventors: Richard A. Chubb, Voorhees, NJ (US); Donald B. Cheke, Saskatoon (CA); Daniel H. Nichols, West Deptford, NJ (US); Charles E. Beck, Sicklerville, NJ (US)

(73) Assignee: THERMOSEAL INDUSTRIES, LLC, Gloucester City, NJ (US)

( * ) Notice: Subject to any disclaimer, the term of this patent is extended or adjusted under 35 U.S.C. 154(b) by 18 days.

(21) Appl. No.: 15/234,056

(22) Filed: Aug. 11, 2016

(65) Prior Publication Data

US 2017/0043922 A1 Feb. 16, 2017

Related U.S. Application Data

(60) Provisional application No. 62/204,593, filed on Aug. 13, 2015.

(51) Int. Cl.

| | |
|---|---|
| ***B65D 85/46*** | (2006.01) |
| ***B65B 13/02*** | (2006.01) |
| ***B65D 19/44*** | (2006.01) |
| ***B65B 5/06*** | (2006.01) |
| ***B65D 71/00*** | (2006.01) |

(52) U.S. Cl.

CPC ..... *B65B 13/02* (2013.01); *B65B 5/068* (2013.01); *B65D 19/44* (2013.01); *B65D 71/0096* (2013.01); *B65D 2519/00273* (2013.01); *B65D 2519/00815* (2013.01); *B65D 2571/00037* (2013.01); *B65D 2571/00055* (2013.01);

(Continued)

(58) Field of Classification Search

CPC ..... B65B 13/02; B65B 5/068; B65B 13/022; B65D 19/44; B65D 71/0096; B65D 85/46; B65D 19/385; B65D 21/0209

USPC ..... 206/325, 564, 557, 585, 386, 454, 321, 206/593, 449; 108/53.1

See application file for complete search history.

(56) References Cited

U.S. PATENT DOCUMENTS

| | | | | |
|---|---|---|---|---|
| 3,494,459 A * | 2/1970 | Wallestad | ..... | B65D 73/02 206/499 |
| 4,583,639 A * | 4/1986 | Fedick | ..... | B65D 85/48 206/325 |

(Continued)

FOREIGN PATENT DOCUMENTS

| | | |
|---|---|---|
| GB | 212472 A | 3/1924 |
| WO | 2015050490 A2 | 4/2015 |

OTHER PUBLICATIONS

International Search Report and Written Opinion for International Application No. PCT/US2016/046455, dated Nov. 2, 2016, 11 pages.

*Primary Examiner* — Rafael A Ortiz

(74) *Attorney, Agent, or Firm* — Fredrikson & Byron, P.A.

(57) ABSTRACT

A door packing assembly can include a pallet having a plurality of frames positioned thereon. The plurality of frames define an interior area, and a plurality of doors are positioned onto the pallet within the interior area defined by the plurality of frames. In further instances, a door container component can be positioned onto the pallet and the plurality of doors can be positioned within the door container component. In this way, the door container component can have a perimeter surrounded by at least some of the plurality of frames.

20 Claims, 21 Drawing Sheets

(52) U.S. Cl.
CPC ..... *B65D 2571/00061* (2013.01); *B65D 2571/00074* (2013.01); *B65D 2585/649* (2013.01)

(56) References Cited

U.S. PATENT DOCUMENTS

| | | | | |
|---|---|---|---|---|
| 4,865,200 | A * | 9/1989 | Sullivan | B65D 5/5035 206/583 |
| 4,921,100 | A | 5/1990 | Krause | |
| 5,605,229 | A * | 2/1997 | Sowa | B65D 85/48 206/325 |
| 8,251,220 | B2 * | 8/2012 | Ting | B65D 5/5088 206/454 |
| 2014/0190867 | A1 * | 7/2014 | Shi | B65D 81/113 206/701 |

* cited by examiner

DOOR ASSEMBLY PACKAGING

CROSS-REFERENCE

This application claims priority to U.S. Provisional Patent Application No. 62/204,593, filed Aug. 13, 2015, the entire contents of which are incorporated herein by reference.

TECHNICAL FIELD

This disclosure relates generally to packaging of door assemblies.

BACKGROUND

A door assembly can include a frame and one or more doors. Generally, the door assembly may be manufactured such that the frame is constructed as a separate component from the one or more doors. This allows for convenient installation on site upon delivery, as the frame can be installed easily at the desired location with the one or more doors being subsequently fittingly supported to the frame to complete the door assembly on site.

Where the frame and one or more doors are manufactured as separate components, the frame and one or more doors are also generally packaged for shipment as distinct parts. Namely, an appropriate number of frames are packaged together in a first, usually large, box while an appropriate number of doors are packaged together in a second box. The first and second boxes are loaded onto a trailer for shipment, and this process is repeated until available trailer space has been filled. Where the door assemblies are of a type that includes more than one door per frame (e.g., a left door and a right door), the second box will generally be made to contain an appropriate number of left doors and an additional third box will be used to contain an appropriate number of right doors.

The described packaging and shipment of door assemblies as distinct components in separate boxes can result in an inefficient use of available trailer space. This is particularly the case for door assemblies that include more than one door per frame. In such door assemblies, in addition to the increased trailer space occupied by the additional door boxes, the frames are of an increased size (e.g., cross-sectional area) in order to receive multiple doors. Consequently, a larger box must be used for packing such frames. This results in an increased footprint of the frame box within the trailer, and thus less available trailer space for additional boxes needed for the added doors. Yet, the content of the larger frame box is mostly air.

SUMMARY

In general, this disclosure is directed to improved packaging of door assemblies. The described door packaging assembly embodiments make optimal use of available space so as to allow for a significantly increased number of door assemblies to be shipped without increasing the space needed.

In one example, a door container component is positioned on a pallet and doors are configured within the door container component. The configuration of the doors within the door container component can be such as to optimally use available space within the door container component but at the same time prevent damage to the doors. The door container component can be dimensioned according to an interior area defined by a frame of the specific door assembly. The frame can be positioned around the door container component. Additional frames can also be positioned around the door container component and on top of the initially positioned frame, such that the frames encompass at least a portion of an external surface of the door container component (e.g., a surface of the door container component opposite a surface interfacing with the doors). A frame sleeve can be arranged around the frames for protection.

The details of one or more examples are set forth in the accompanying drawings and the description below. Other features, objects, and advantages will be apparent from the description and drawings, and from the claims.

BRIEF DESCRIPTION OF DRAWINGS

The following drawings are illustrative of particular embodiments of the present invention and therefore do not limit the scope of the invention. The drawings are not necessarily to scale (unless so stated) and are intended for use in conjunction with the explanations in the following detailed description. Embodiments of the invention will hereinafter be described in conjunction with the appended drawings, wherein like numerals denote like elements.

DETAILED DESCRIPTION

The following detailed description is exemplary in nature and is not intended to limit the scope, applicability, or configuration of the invention in any way. Rather, the following description provides some practical illustrations for implementing exemplary embodiments of the present invention. Examples of constructions, materials, and dimensions are provided for selected elements, and all other elements employ that which is known to those of ordinary skill in the field of the invention. Those skilled in the art will recognize that many of the noted examples have a variety of suitable alternatives.

In general, the described door packaging assembly embodiments allow for an optimized number of door assemblies to be loaded and shipped. The door packaging assemblies use space already occupied by the frames to securely accommodate the doors. In addition, various features may be included so as to protect and secure both the doors and frames, for instance, during loading, transit, and unloading. As a result, the described door packaging assemblies can facilitate the shipping of a significantly greater number of door assemblies in a same space as that used in previous door packaging arrangements.

Figure 1:
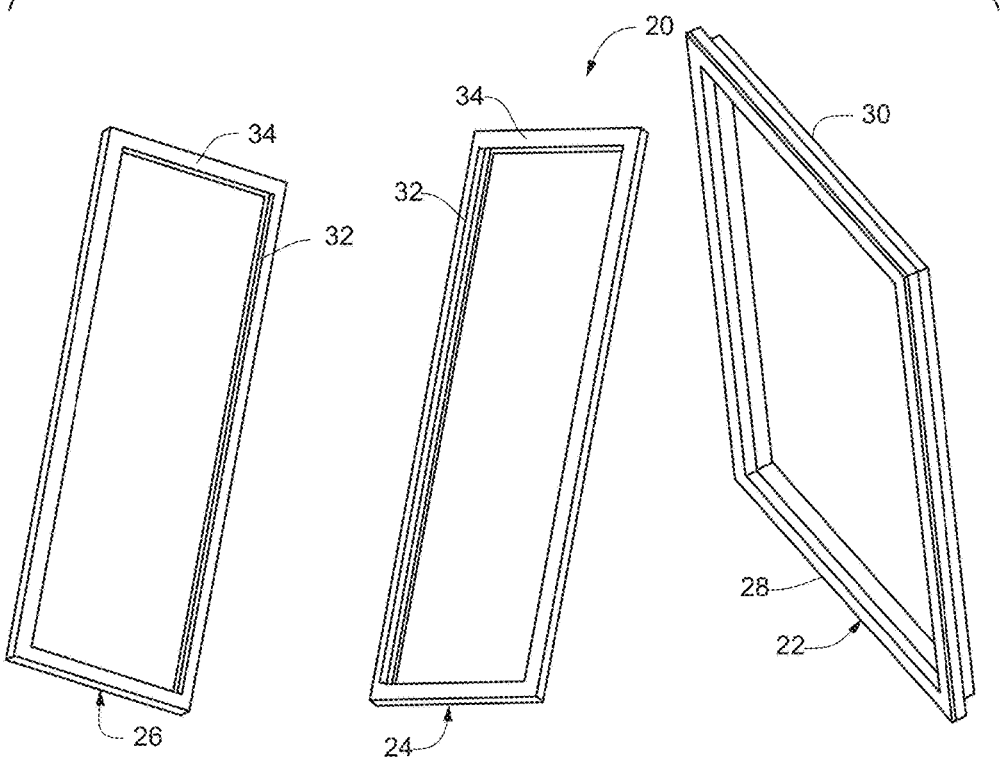
FIG. 1 is a perspective view of components of an embodiment of a door assembly.

FIG. 1 shows a perspective view of components of an exemplary door assembly 20. The illustrated embodiment of the door assembly 20 includes a frame 22, a right door 24, and a left door 26. Other door assembly embodiments can include various numbers of doors per frame, such as a single door 24 or 26. However, the present description will use the example of a two door per frame assembly.

The frame 22, right door 24, and left door 26 may be manufactured as distinct components. The frame 22 can include a front side 28 and a back side 30, with a width of the frame 22 extending between the front side 28 and the back side 30. Each door 24, 26 may include a handle 32 along a front side 34 of the doors 24, 26. Both the frame 22 and doors 24, 26 may be dimensioned such that the frame 22 fittingly supports both doors 24, 26 within the frame 22 upon assembly (e.g., on site). For instance, in one embodiment the doors 24, 26 may be pivotally coupled to the frame 22, while in another embodiment the doors 24, 26 may be slidingly coupled to the frame 22.

With the exemplary door assembly 20 having now been described, the remainder of the present description will detail optimal packaging of the door assembly 20.

Figure 2:
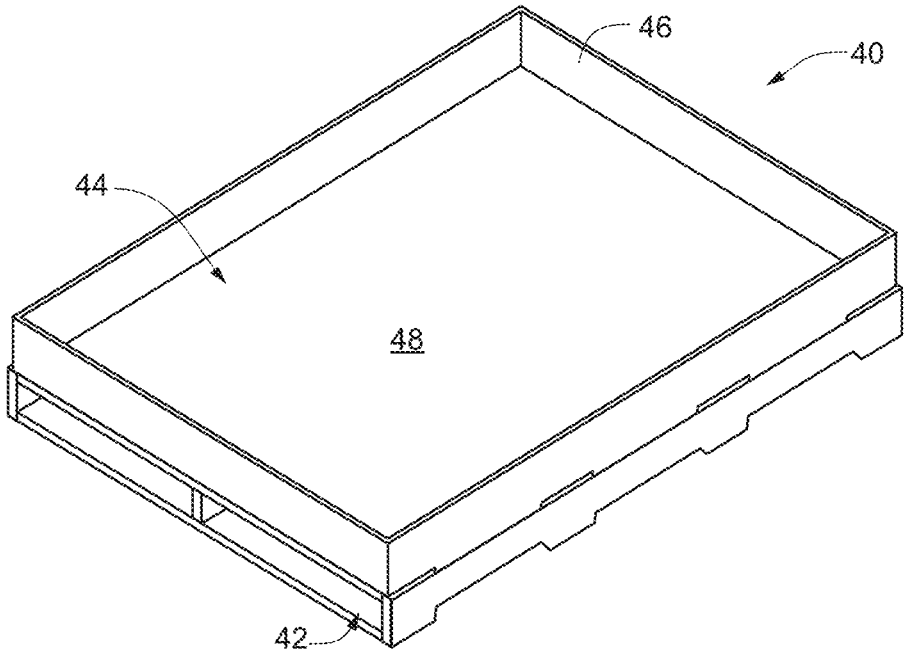
FIG. 2 is a perspective view of a pallet and tray arrangement.

FIG. 2 shows a perspective view of a pallet and tray arrangement 40. The arrangement 40 includes a pallet 42 and a tray 44 overlaying a surface of the pallet 42. The pallet 42 can serve as a base of the door assembly package. Tray 44 can include sides 46 radially protruding up a distance from a surface of the tray 44 around a perimeter of tray 44. The sides 46 can define an interior area 48 of the tray 44, and in embodiments where the sides 46 extend along the perimeter of the tray 44 the area of the tray 44 will be substantially equal to the interior area 48 defined by the sides 46. In the illustrated embodiment, the tray 44 is dimensioned to have the same, or substantially the same, length and width as the pallet 42 so that the tray 44 does not protrude out from a perimeter of the pallet 42. This can allow interfacing surfaces of pallets loaded onto a trailer adjacent one another to be flush, and consequently optimize the use of space within the trailer.

Figure 3A:
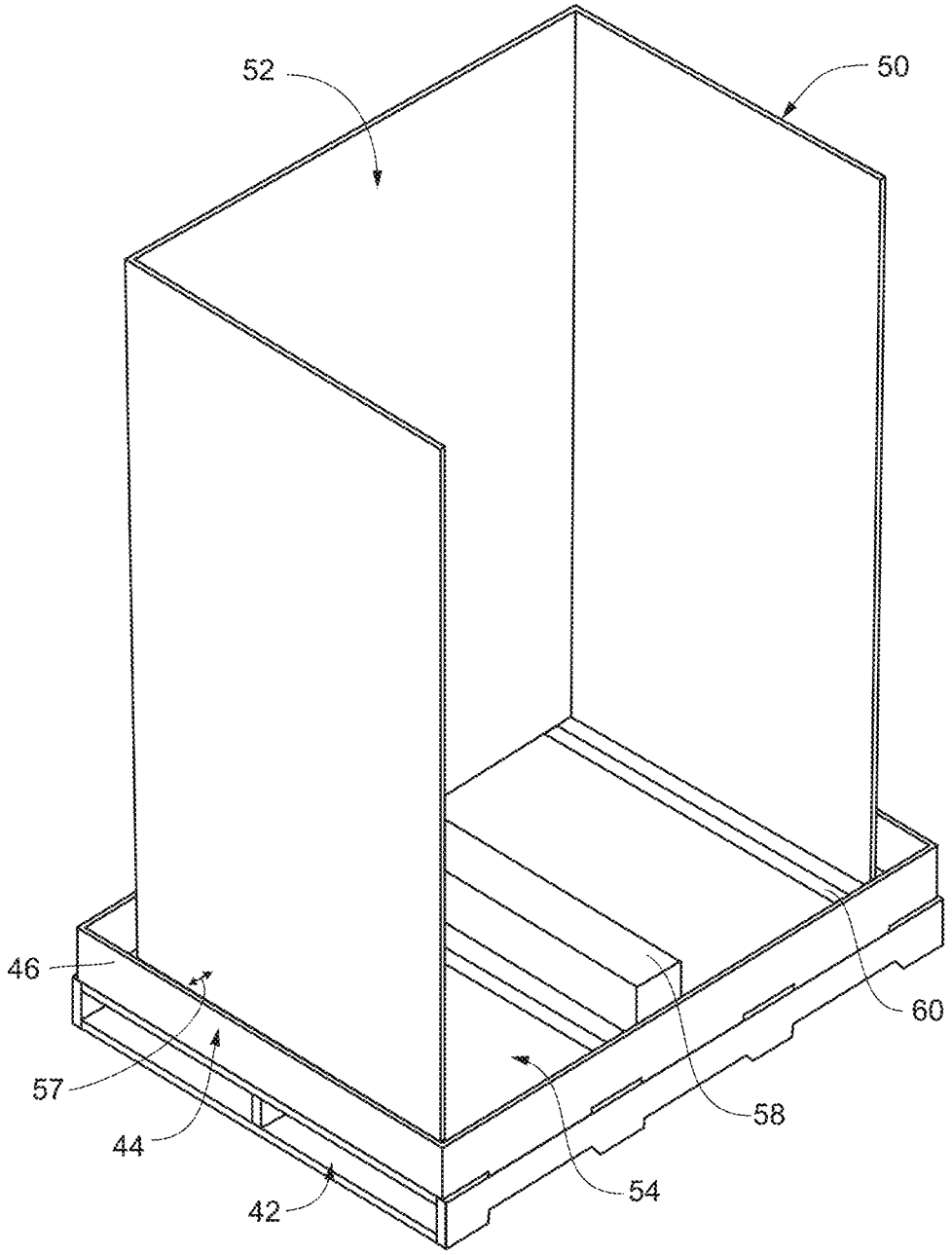
FIG. 3A is a perspective view of an embodiment of a door container component partially assembled.
Figure 3B:
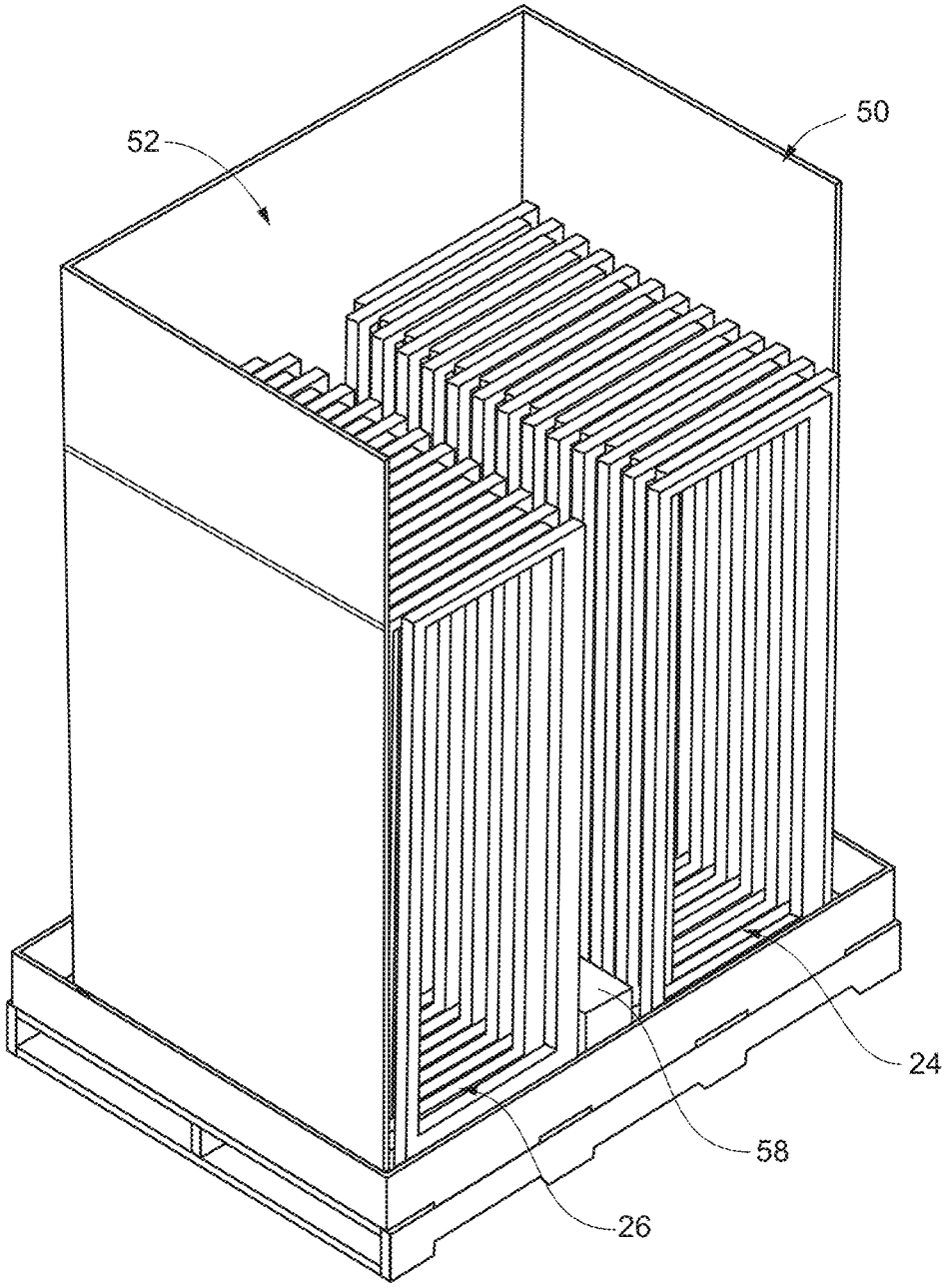
FIG. 3B is a perspective view of the door container component of FIG. 3A with doors positioned within the door container component.
Figure 3C:
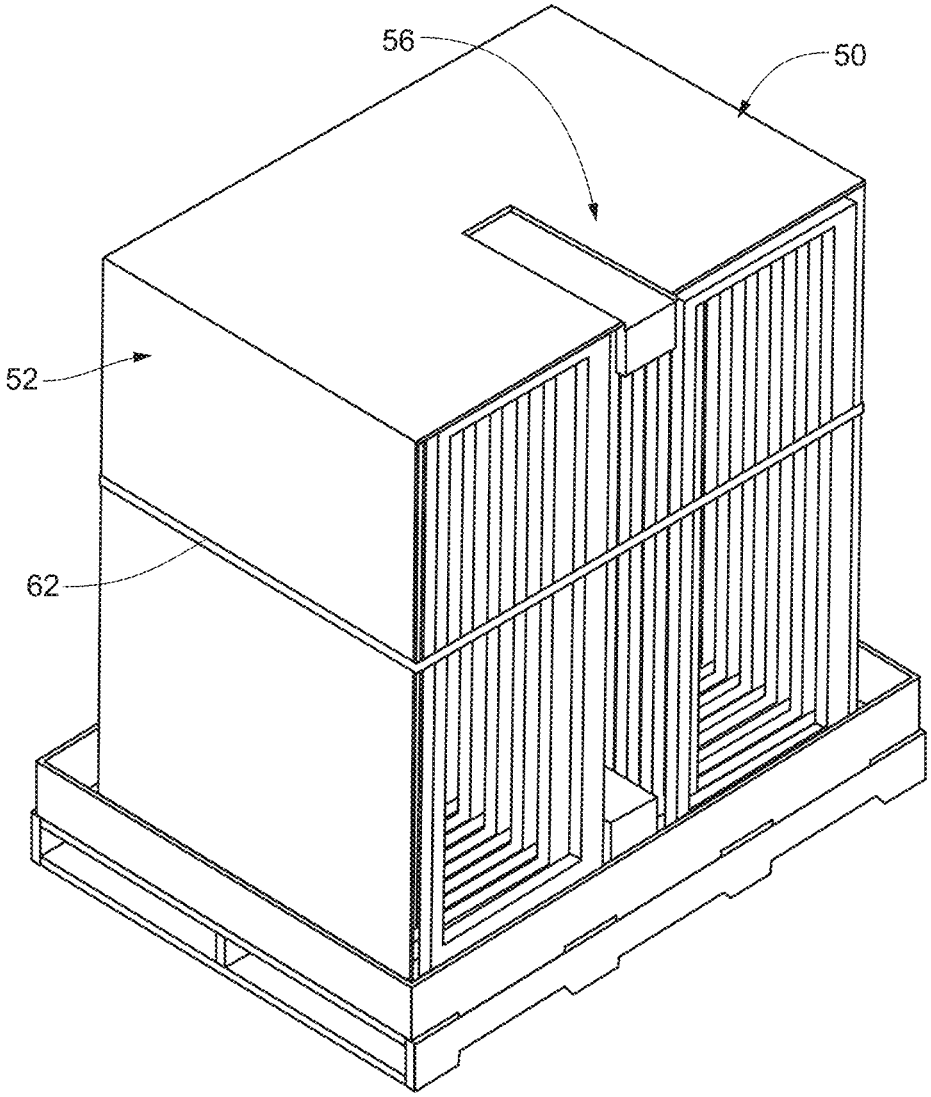
FIG. 3C is a perspective view of additional components assembled as part of the door container component of FIG. 3B.
Figure 3D:
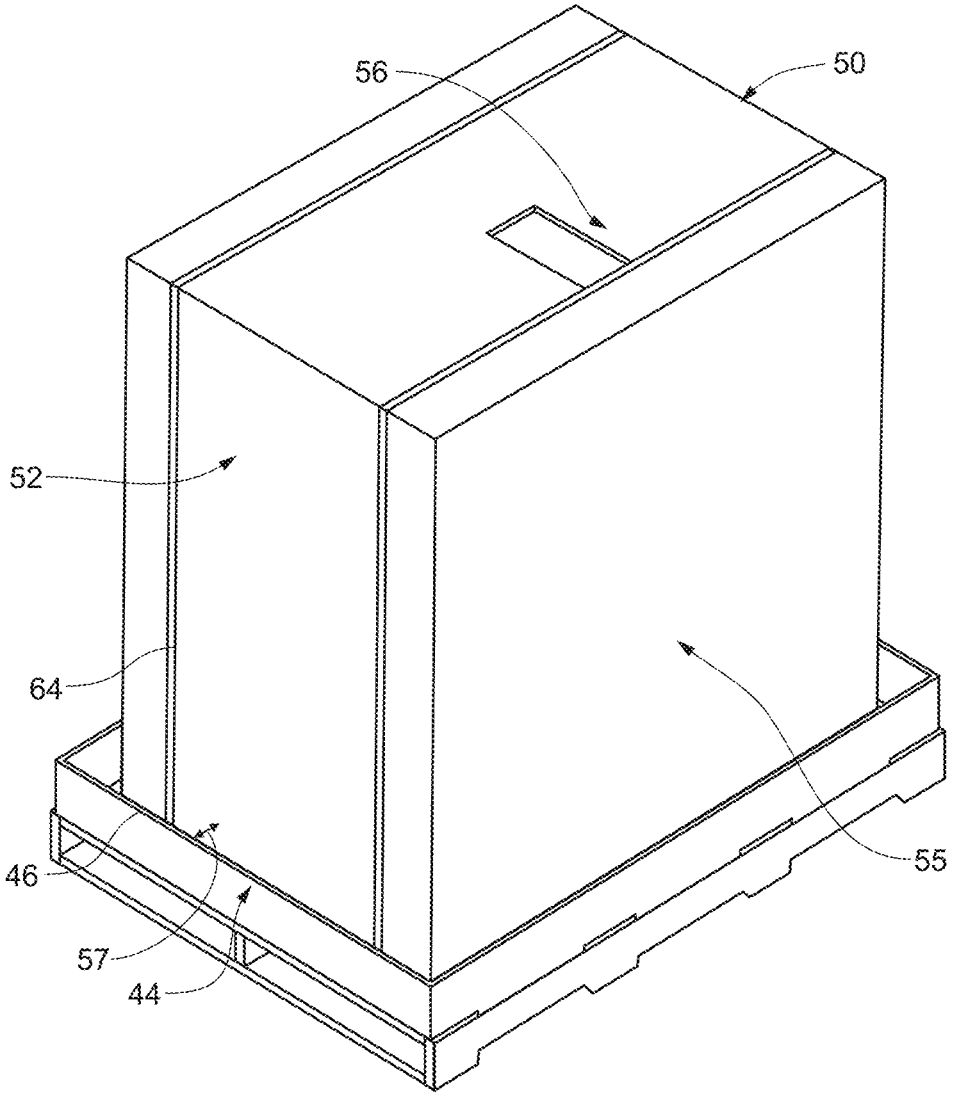
FIG. 3D is a perspective view of an embodiment of a completed assembly of the door container component.

FIGS. 3A-3D show perspective views of an embodiment of a door container component 50. FIG. 3A illustrates a perspective view of the door container component 50 partially assembled. FIG. 3B shows a perspective view of the door container component 50 of FIG. 3A with doors 24, 26 positioned within the door container component 50. FIG. 3C illustrates additional components assembled as part of the door container component 50 of FIG. 3B, while FIG. 3D illustrates a completed assembly of the door container component 50.

As shown in FIG. 3A, door container component 50 can include a first sash box portion 52 and a bottom door holder 54. The first sash box portion 52 of the illustrated example includes three sides, while the fourth side and/or top can be left temporarily open and later supplied as part of a second sash box portion 55 and/or top door holder 56 (see FIG. 3D) of the door container component 50. Leaving the fourth side and/or top temporarily open can facilitate convenient loading of doors 24, 26 into the first sash box portion 52 before fully assembling the remainder of the door container component 50. The bottom of the first sash box portion 52 can have each of the three sides folded inward into the interior of the first sash box portion 52 (i.e. away from the sides 46 of the tray 44) at an approximately 90° angle. Optionally, a filler component can be used at the bottom of the first sash box portion 52 in instances where the folded three sides of the bottom of the first sash box portion 52 fail to cover an area at the bottom of the first sash box portion 52 enclosed by the three sides. The first sash box portion 52 as shown can be dimensioned so as to fit within the tray 44 (e.g. centered within the tray 44) to define a space 57 between the perimeter of the sash box 52 and the sides 46 of the tray 44.

Bottom door holder 54 can be dimensioned to fit within the first sash box portion 52 of the door container component 50. The bottom door holder 54 may include a separator 58 and one or more positioning strips 60. In the embodiment shown, bottom door holder 54 has the separator 58 extending substantially along a width of the holder 54 at the center of the holder 54. As seen in FIG. 3B, the separator 58 can function to keep the doors 24, 26 stacked on each side of the separator 58 from coming into contact. The illustrated embodiment of the bottom door holder 54 also includes four positioning strips 60 extending substantially along the width of the holder 54, with two strips 60, spaced one from the other, on each side of the separator 58. In other embodiments, a single strip 60 may be used on each side of the separator 58. Each strip 60 can be in contact with the door container component 50 on a first side of the strip 60 and one of the stacks of doors on a second, opposite side of the strip 60. The strips 60 can serve to prevent the doors 24, 26 stacked on top of the strips 60 from sliding during movement of the door container component 50 (e.g., during loading, shipping, unloading). In many applications, the weight of the doors 24, 26 stacked on the strips 60 will act to compress the doors 24, 26 into the strips 60 for further securing the doors 24, 26 in position inside the container component 50. The strips 60 can be made of any type of material useful for helping to prevent sliding of the doors 24, 26 inside the container component 50. For example, foam tape can be used as the strips 60 in some applications, while in other applications any type of material that will create a high enough coefficient of friction between the doors 24, 26 and the strips 60 to substantially prevent movement of the doors 24, 26 can be used.

As shown in the example of FIG. 3B, the doors 24, 26 can be positioned within the door container component 50. In some embodiments, the right doors 24 can be stacked on a first side of the separator 58 while the left doors 26 can be stacked on a second, opposite side of the separator 58. In one example, the doors 24, 26 can be stacked on each side of the separator 58 in a staggered configuration. For instance, where a staggered configuration of the doors 24, 26 is to be used, the strips 60 on each side of the separator 58 can be spaced from each other a distance greater than the width of the doors 24, 26. In this manner, a first door 26 positioned on the first side of the separator 58 in the door container component 50 can have one of its edges located on the strip 60 closest to the separator 58, while the second door 26 positioned on the first side of the separator 58 can have one of its edges located on the strip 60 furthest from the separator 58. This staggered door configuration can be repeated for subsequently loaded doors 24, 26. In such a configuration, each door 24, 26 may only contact one of the two strips 60 on the respective side of the separator 58. In some cases, the doors 24, 26 can be positioned onto the pallet 42 and/or tray 44 directly without use of the door container component 50, in which cases frames can be added to surround the doors 24, 26 directly.

In other embodiments, the doors 24, 26 can be configured in a manner, in addition to or as an alternative to the staggered configuration, that takes into account the handles 32 on the front side 34 of each door 24, 26 (see FIG. 1). It can be beneficial to position the doors on the end of the door stacks on each side of the separator 58 such that the handles 32 of these doors face in to the interior of the door container component 50. In other words, the back side of the door immediately interfaces with the door container component 50, while the front side of the door having the handle is opposite the door container component 50. This can help to prevent damage to the doors 24, 26 during loading and transit. Once the first door is positioned on the receptive side of the separator 58 with the handle 32 facing inward, the next door can be positioned so that the front surface with the handle of this next door faces the front surface with the handle of the first door. Similarly, subsequently loaded doors can follow this configuration where pairs of doors are positioned to have their respective handles interfacing (i.e. front surfaces of each pair interface). Depending on whether there is an odd or even number of doors positioned on the respective sides of the separator 58, the last door positioned into the door container component 50 may have its front surface (with the handle) interfacing with the back surface of the next immediate door in the stack. This prevents the handle of the last door in an odd number door stack from facing outward and interfacing with the door container component 50. By configuring the doors in the manner described taking into account the handles of each door, contact between a handle of one door and a back surface of an immediately adjacent door can be prevented and damage during loading and transit can be minimized.

To further protect the doors loaded into the door container component 50, protective material can be disposed between each door, or between each pair of doors, on a same side of the separator 58. Such protective material can include, in some examples, cork board or other similar material.

When the doors 24, 26 have been loaded, additional components can be added to the door container component 50 as shown in FIGS. 3C and 3D. In one example, the top door holder 56 can be added and the tops of the three sides of the first sash box portion 52 can be folded inward into the interior of the first sash box portion 52 at an approximately 90° angle. This can result in the tops of the three sides laying on top of the door holder 56. The top door holder 56 can have a same configuration as that described for the bottom door holder 54, such that the top door holder 56 can include a separator and strips to additionally secure the doors in position. One or more bandings 62 can be added around the door container component 50, for instance, in a plane parallel to the pallet as seen in FIG. 3C.

In addition, the second sash box portion 55 can be added to form at least the fourth side of the door container component 50. In some embodiments, the second sash box portion 55 can include additional surfaces that overlap with one or more of the three sides, top and/or bottom, of the first sash box portion 52 to provide additional support. In the illustrated example, the second sash box portion 55 is added after the one or more bandings 62 have been secured. One or more bandings 64 can be secured around the door container component 50, such as in one or more planes substantially perpendicular to both the pallet and the plane of the one or more bandings 62. In some instances, the one or more bandings 64 can be configured to pass through an aperture created in the tray 44 and through the pallet (e.g., under a top surface of the pallet and above a bottom surface of the pallet). Bandings 64 arranged in this manner can secure the door container component 50 to both the tray 44 and pallet. As can be seen in FIG. 3D, the door container component 50 is secured within the interior area of the tray 44 in a manner that defines the space 57 between the perimeter of the door container component 50 and the sides 46 of the tray 44.

Figure 4:
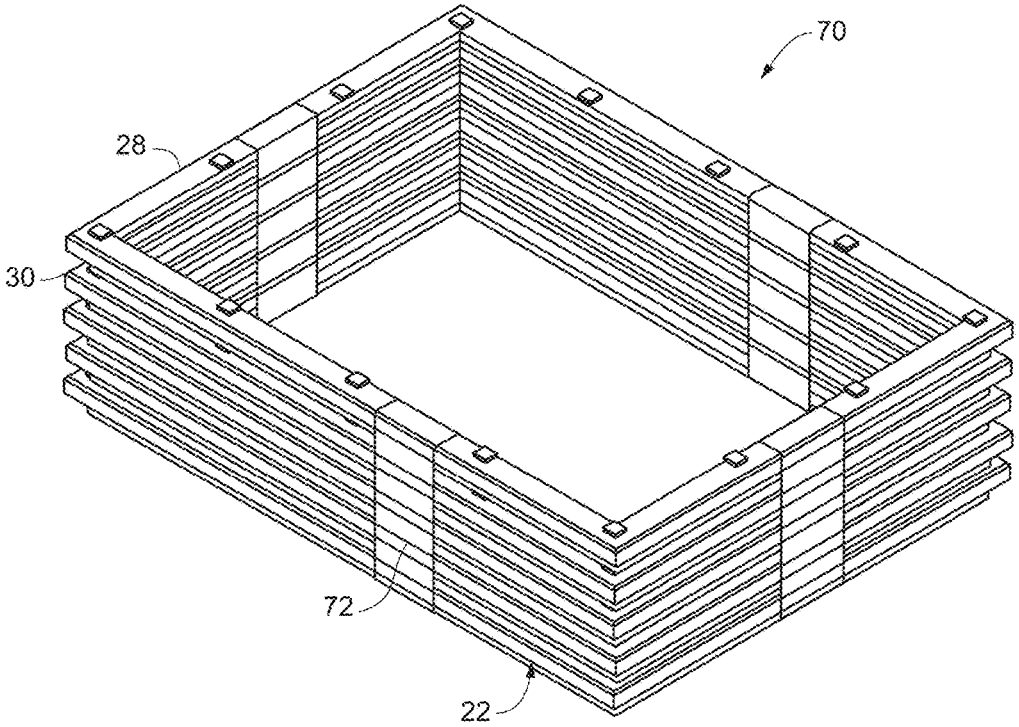
FIG. 4 is a perspective view of an embodiment of a stack of frames.

FIG. 4 shows a perspective view of an embodiment of a stack 70 of frames 22. The stack 70 as shown includes five frames 22, but any number of frames 22 can be included in stack 70 in other examples. The frames 22 are arranged in stack 70, for instance, such that each frame 22 has its back surface 30 facing down and its front surface 28 facing up. Thus, in this example, the front surface 28 of the frame 22 at the bottom of the stack 70 interfaces with the back surface 30 of the next frame 22 in the stack. An appropriate number of wraps 72 can be arranged around the stack 70 at various locations to secure the individual frames 22 together.

Figure 5A:
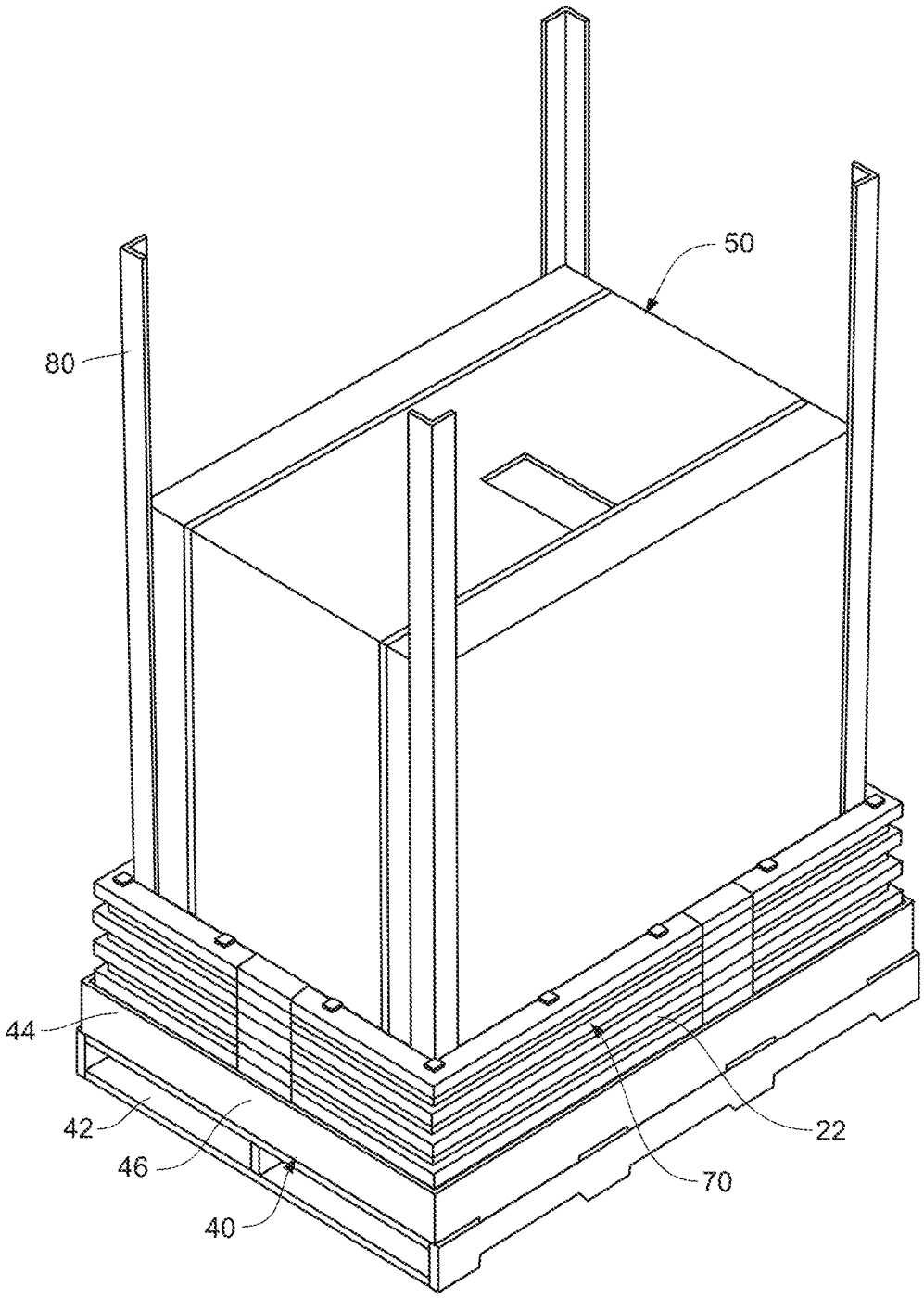
FIG. 5A is a perspective view of an embodiment of an initial frame stack added to the pallet and tray arrangement and door container component.
Figure 5B:
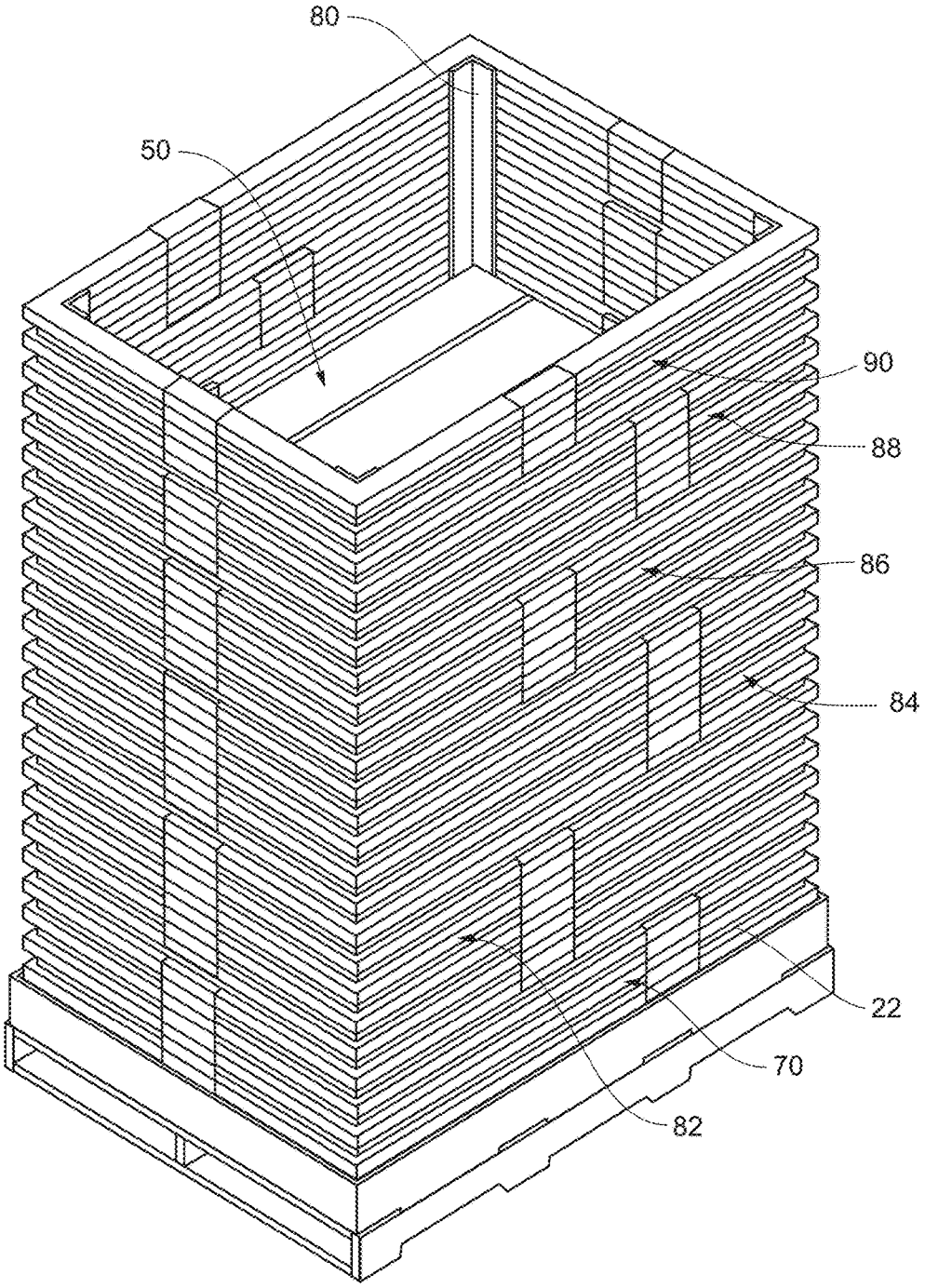
FIG. 5B is a perspective view showing additional stacks of frames added to the illustration of FIG. 5A.
Figure 5C:
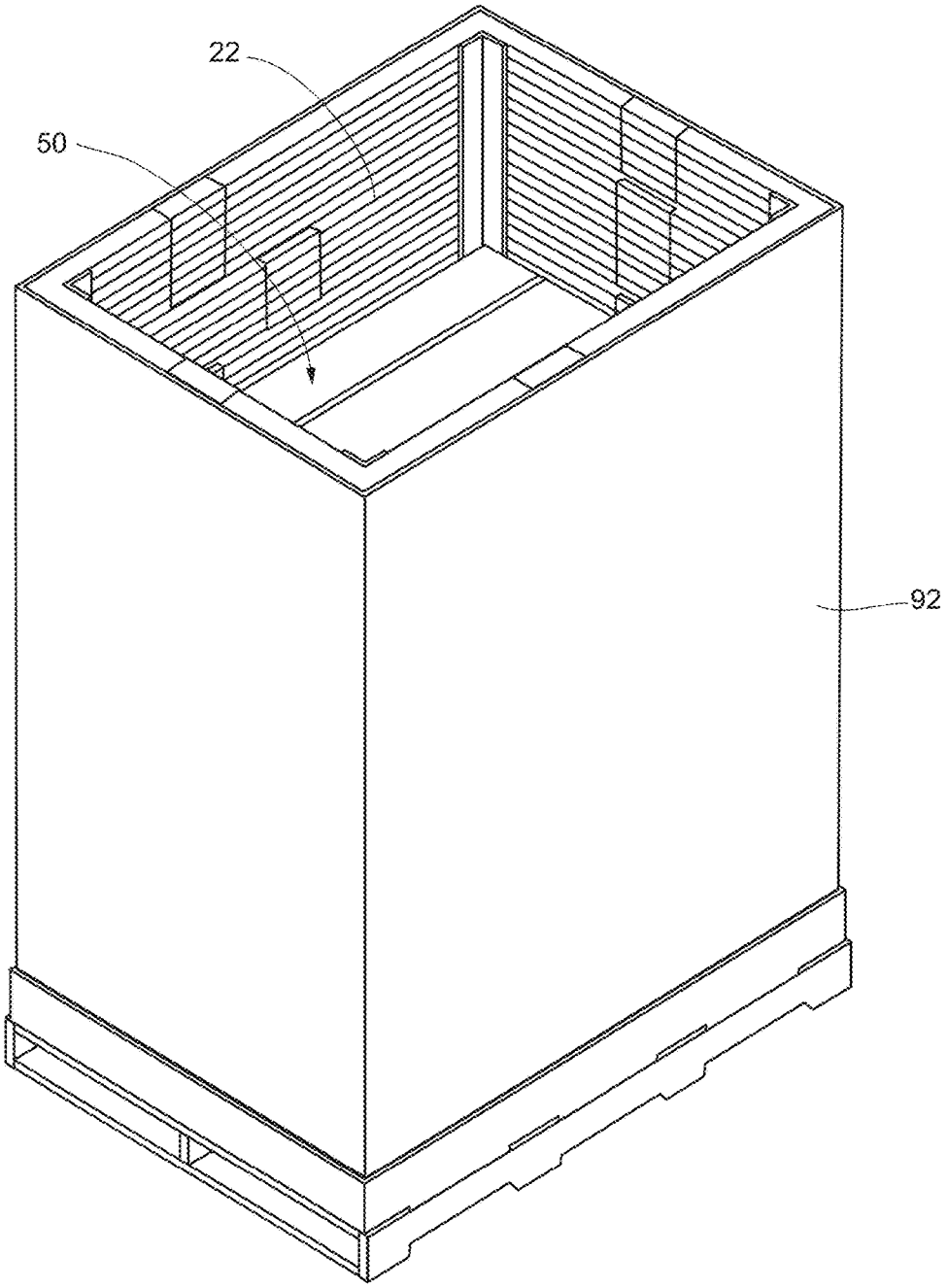
FIG. 5C is a perspective view showing a frame sleeve added to the illustration of FIG. 5B.

FIGS. 5A-5C illustrate embodiments with the addition of frames 22 to the pallet and tray arrangement 40 and door container component 50 previously described. FIG. 5A shows a perspective view of the initial stack 70 of frames 22 added to the pallet and tray arrangement 40 and door container component 50. FIG. 5B is a perspective view showing additional stacks 70 of frames 22 added to the illustration of FIG. 5A. FIG. 5C is a perspective view showing a frame sleeve added to the illustration of FIG. 5B.

As shown in FIG. 5A, an initial stack 70 of frames 22 is added to the arrangement 40 of the pallet 42 and tray 44 and door container component 50. As such, the initial stack 70 of frames 22 can bound the doors 24, 26. In other words, the doors 24, 26 can be positioned within an interior area defined by the initial stack 70 of frames 22. The initial stack 70 can be configured to be at least partially positioned in the space between the perimeter of the door container component 50 and the sides 46 of the tray 44. For example, one or more frames 22 of the stack 70 may, in some instances, be entirely within the space between the door container component 50 and the sides 46 while one or more frames 22 of the stack 70 may extend radially out from the space (e.g. up from the tray 44). As shown, the frames 22 surround a perimeter of the door container component 50. To accommodate the described configuration, the tray 44 may be dimensioned for the particular application depending on the size of the frames 22 used in the particular door assembly.

Corner protectors 80 can further be added either before or after the initial stack 70 is added to the arrangement 40 of the pallet 42 and tray 44 and door container component 50. In some instances, it may be convenient to include the corner protectors 80 after the initial stack 70 has been added, so as to allow the initial stack 70 to provide an interference fit between the stack 70 and the door container component 50 for holding the corner protectors 80 in place. The corner protectors 80 can help to protect the doors inside the door container component 50 from contact with the frames 22.

As seen in FIG. 5B, once the initial stack 70 of frames 22 has been positioned, subsequent stacks 82, 84, 86, 88, and 90 can be added on top of the initial stack 70. The stacks can include any number of frames 22. In the illustrated embodiment, the initial stack 70 as well as immediately adjacent stacks 82 and 84 near the bottom of the arrangement each include five frames 22 secured together by wraps. As the frame stacks proceed up from the initial stack 70, the stacks can have fewer frames 22 included within the stack. For example, stack 86 near the middle of the arrangement includes four frames 22 and stacks 88 and 90 at or near the top of the arrangement include three frames 22. This decreasing size of frame stacks from the bottom to the top of the arrangement help to increase stability.

Corner protectors 80 may be sized so as to be as tall as the cumulative stacks of frames 22 used in the arrangement. As shown, the stacks of frames, as well as the corner protectors 80, may extend above the top of the door container component 50. The interference fit between the corner protectors 80 and the stacks of frames at or near the bottom of the arrangement can provide counterforces to the corner protectors 80 helpful in supporting the portions of the corner protectors 80 extending above the top of the door container component 50. Therefore, in addition to providing protection for the doors inside of the door container component 50, the corner protectors 80 can further act to secure frames 22 extending above the top of the door container component 50.

As shown in FIG. 5C, once the stacks of frames have been added, a frame sleeve 92 can be included. The frame sleeve 92 surrounds an outer facing surface of the frames 22 and helps to protect the frames 22 from scratching or other damage. The frame sleeve 92 can be as tall as the stack of frames and can be made up of more than one section. For example, the frame sleeve 92 can include two separate sections that each wrap around just over half of the stacks such that the two sections overlap and can be secured together. Using a frame sleeve that includes more than once section can be convenient when installing the frame sleeve around the frames 22. Otherwise, an integral frame sleeve will need to be slipped over the top of the stacks. Optionally, the frame sleeve 92 can further include a top lid (shown in FIG. 6A) for enclosing the top of the cumulative frame stacks.

Figure 6A:
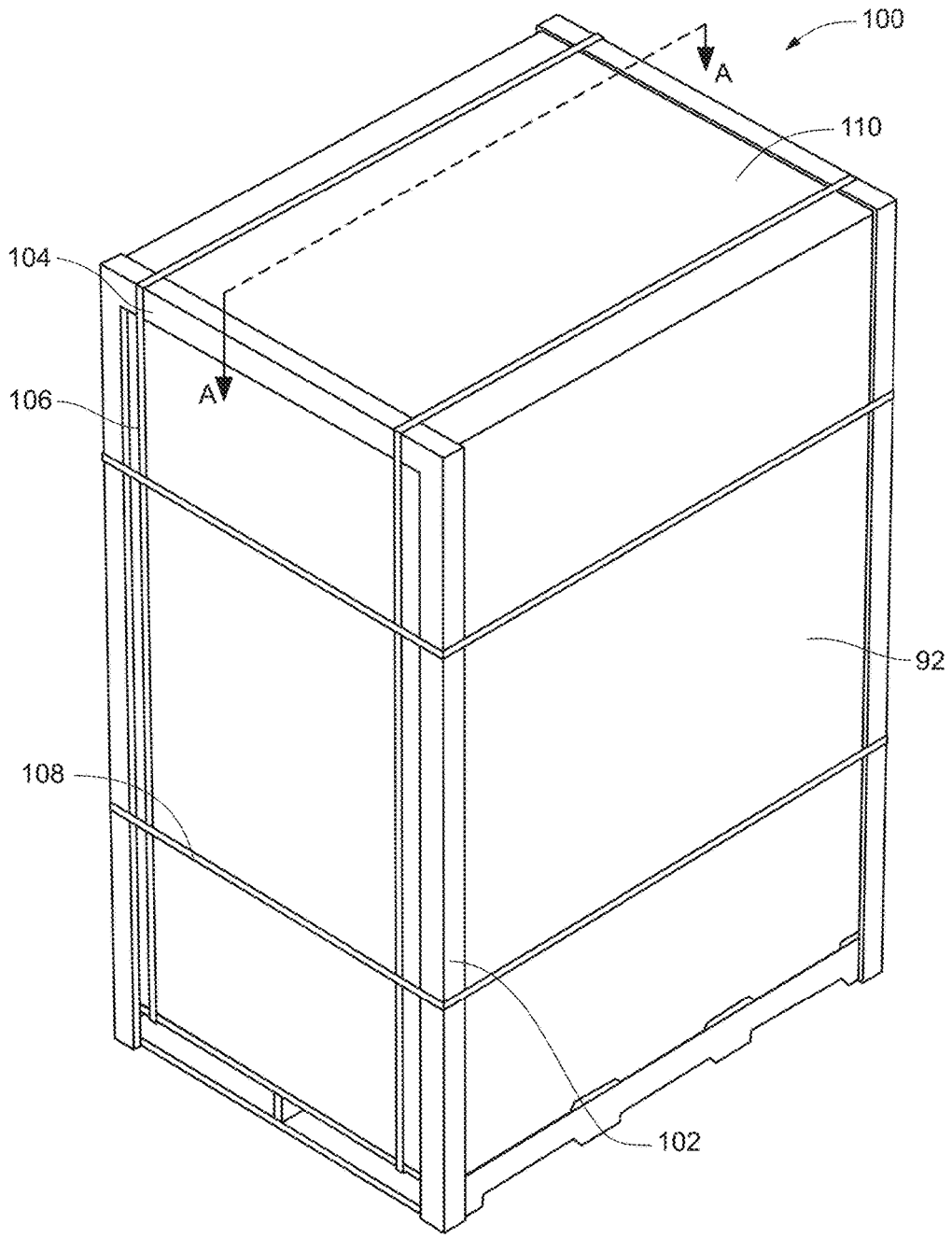
FIG. 6A is a perspective view of an embodiment of a door packaging assembly.
Figure 6B:
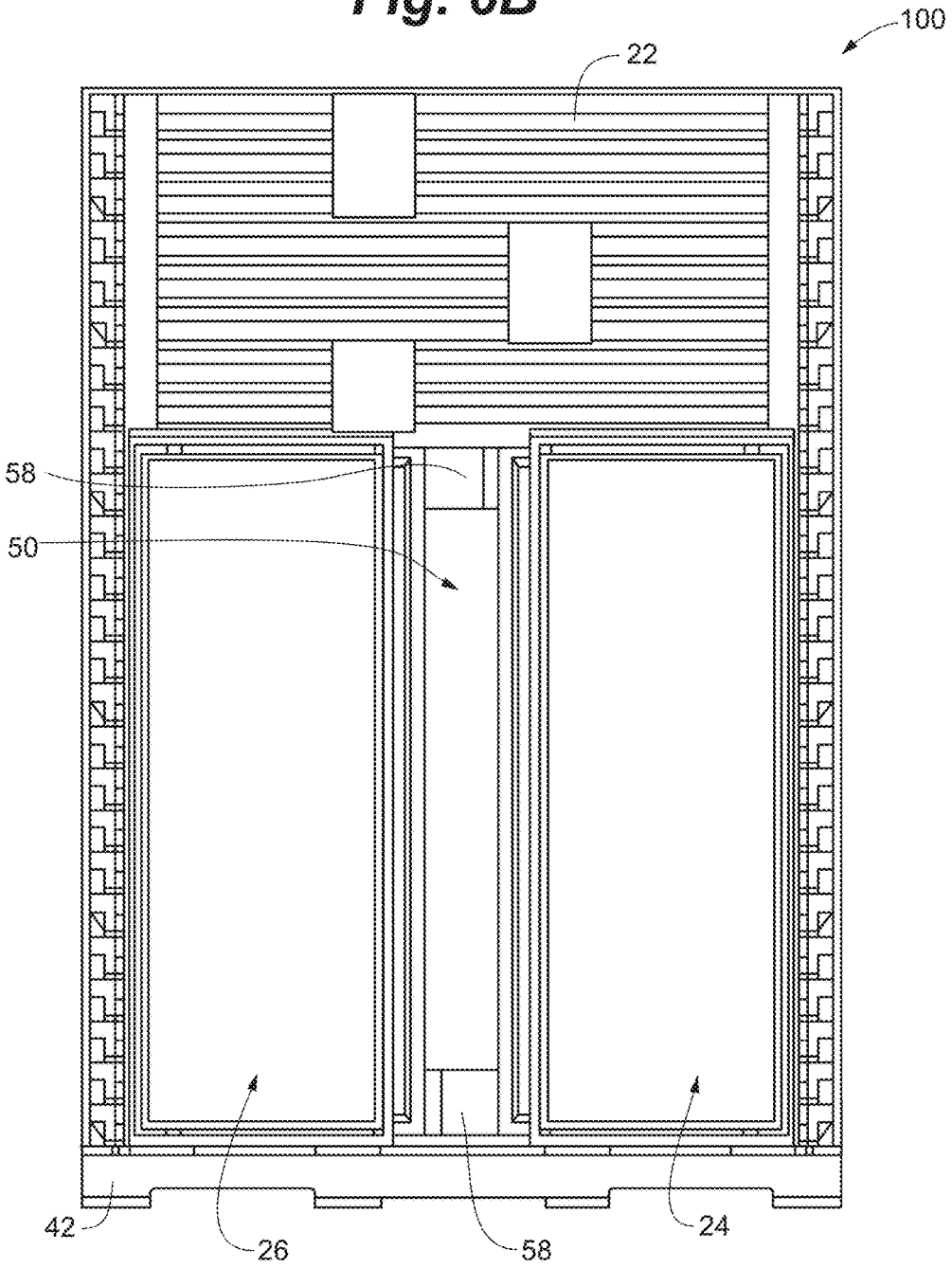
FIG. 6B is a cross-sectional view of the door packaging assembly embodiment taken along line A-A of FIG. 6A.

FIGS. 6A and 6B illustrate a completed door packaging assembly 100. FIG. 6A shows a perspective view of the completed door packaging assembly 100, while FIG. 6B shows a cross-sectional view of the completed door packaging assembly 100 taken along line A-A of FIG. 6A.

The door packaging assembly 100 can include vertical and horizontal corner protectors 102 and 104, respectively, as well as vertical and horizontal banding 106 and 108, respectively, secured around the frame sleeve 92 (including the top lid 110). As shown in the cross-sectional view of FIG. 6B, the doors 24, 26 are positioned inside of the door container component 50 with the frames 22 positioned around the perimeter of the door container component 50 (and thus the doors 24, 26). The stacks of doors 24, 26 are kept from coming into contact by the separators 58. In the present example, the doors 24, 26 are arranged inside the door container component 50 in a staggered configuration, where the doors in each stack alternate being positioned on the outside closest to the door container component 50 and on the inside closest to the separators 58. The exemplary door packaging assembly 100 includes twenty-five door assemblies (e.g., twenty-five frames 22, twenty-five right doors 24, and twenty-five left doors 26).

Significantly, in door packaging assembly 100 multiple door assemblies (e.g., doors 24, 26 and frames 22) are thus packaged onto a single pallet 42 that has the same footprint as a pallet that otherwise would ordinarily only include the frames 22. Consequently, the number of door assemblies that can be loaded onto a trailer for shipment can be significantly increased.

Figure 7:
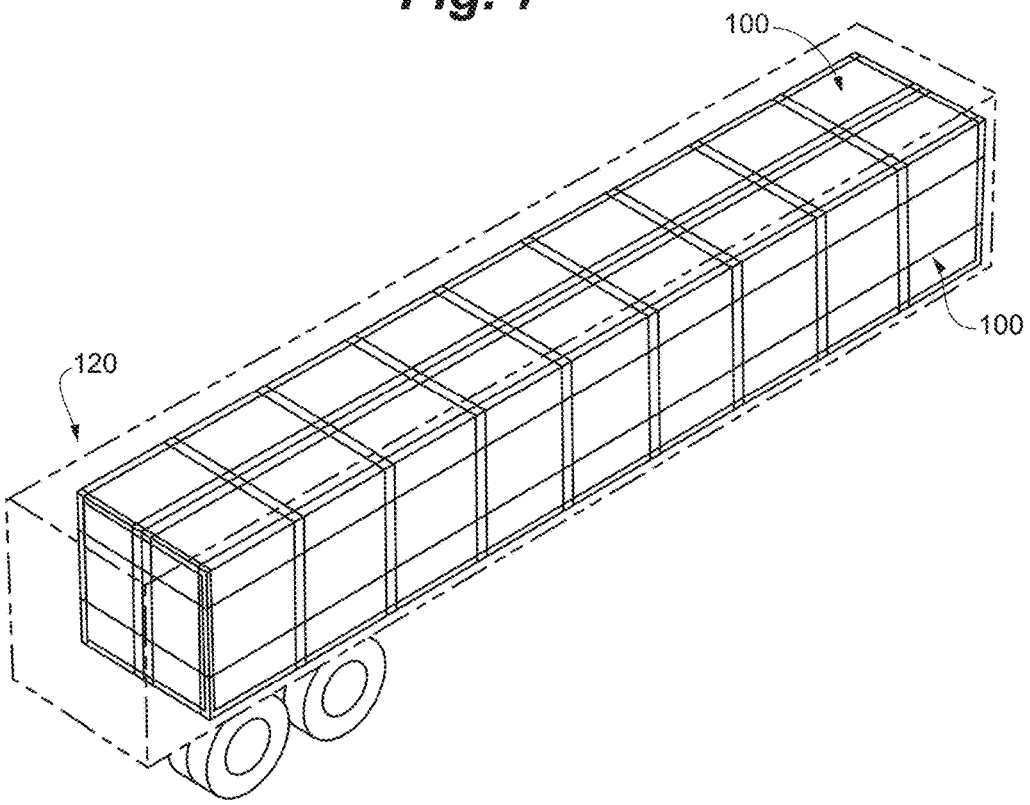
FIG. 7 is a perspective view of an exemplary loaded configuration of door packaging assemblies on a trailer.

FIG. 7 is a perspective view showing an exemplary loaded configuration of door packaging assemblies on a trailer 120. The trailer 120 is a typical fifty-three foot trailer. Each door packaging assembly 100 includes twenty-five door assemblies, with the door assemblies loaded two wide and nine long for a total of eighteen door packaging assemblies 100 on the trailer 120. Thus, the total number of door assemblies that can be loaded onto the trailer 120 is four hundred and fifty. In prior art door assembly packagings, where the frames and each set of doors of the door assemblies are packaged in separate boxes, the trailer 120 could generally accommodate one hundred and fifty door assemblies. Therefore, the presently described door packaging assembly 100 may result in a three hundred percent increase in the number of door assemblies that can be loaded onto the trailer 120.

Various other door packaging assemblies can be used in a configuration similar to that described here, with variations to accommodate the dimensions of the particular door assembly. In particular, the door packing assembly can be varied based on the size of the frame of the specific door assembly, such that the arrangement of the doors is configured so as to fit within the specific frame.

Figure 8A:
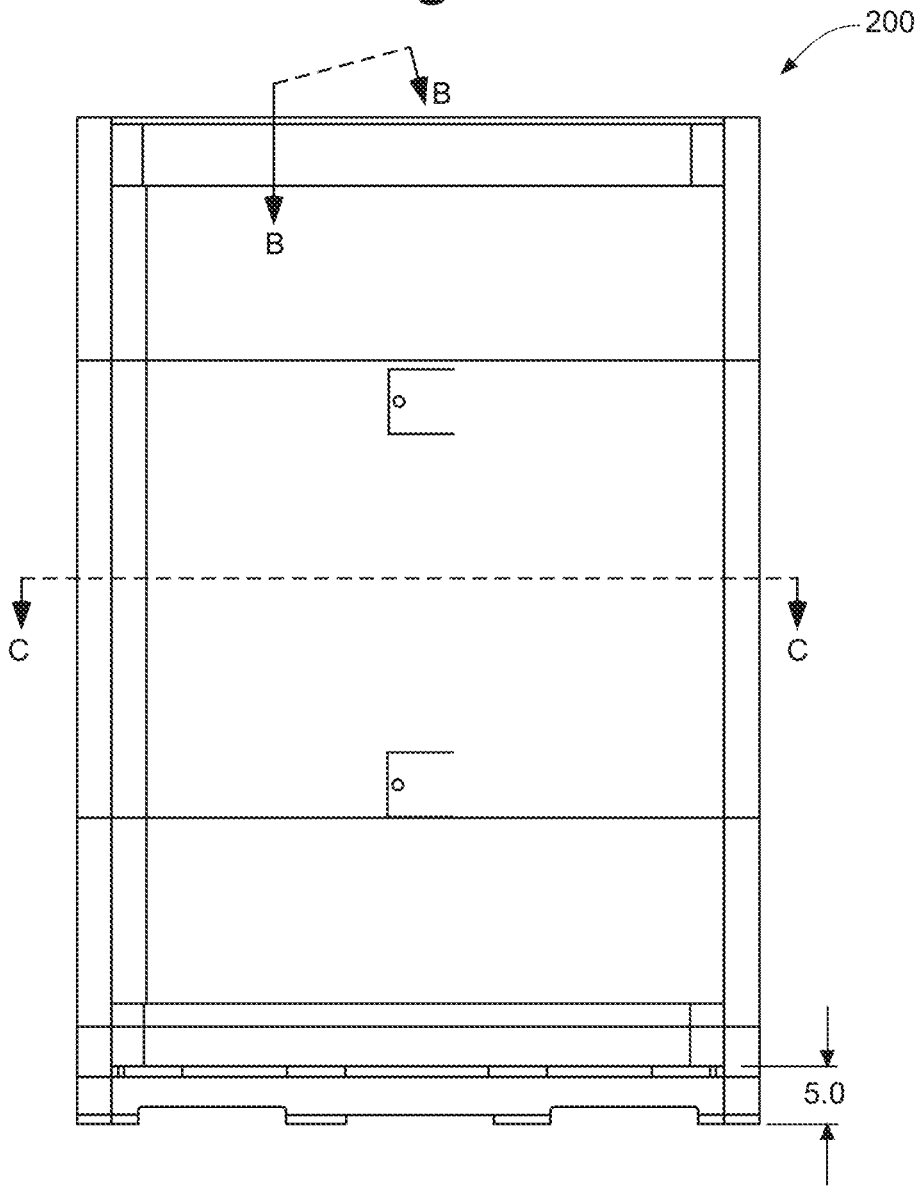
FIG. 8A is an elevational view of another embodiment of a door packaging assembly.
Figure 8B:
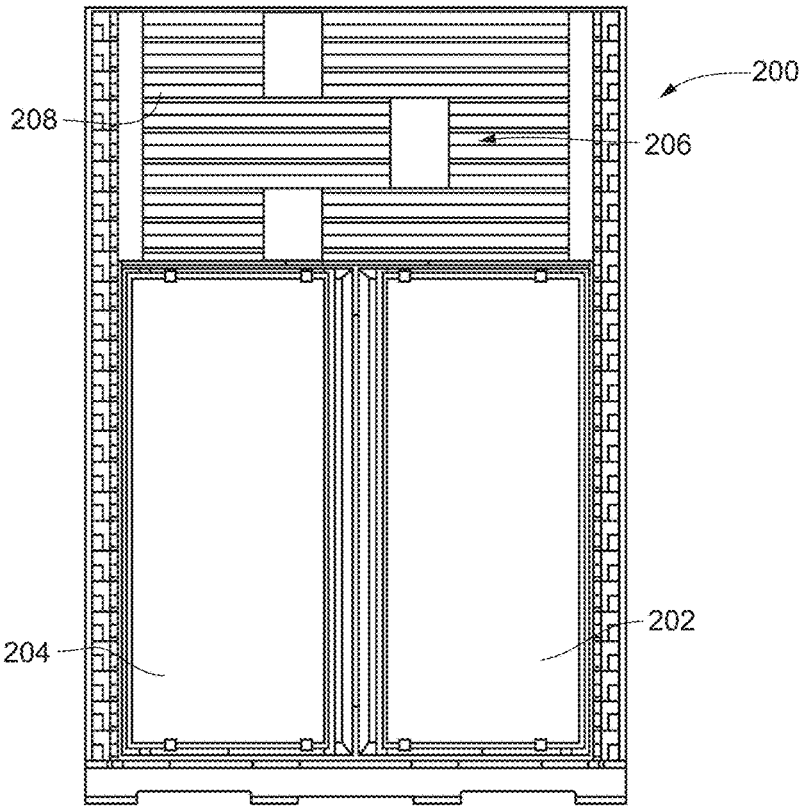
FIG. 8B is a cross-sectional view of the door packaging assembly of FIG. 8A taken along line B-B of FIG. 8A.
Figure 8C:
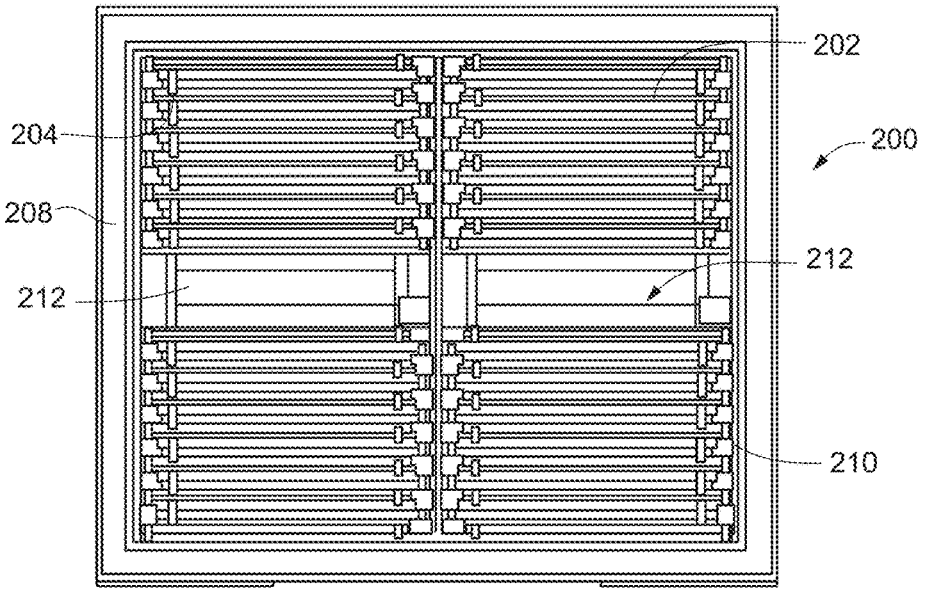
FIG. 8C is a cross-sectional view of the door packaging assembly of FIG. 8A taken along line C-C of FIG. 8A.

FIGS. 8A-8C show another embodiment of a door packaging assembly 200. FIG. 8A shows a perspective view of the door packaging assembly 200, while FIGS. 8B and 8C show cross-sectional views of the door packaging assembly 200 taken along lines B-B and C-C, respectively, of FIG. 8A.

Door packaging assembly 200 can have a similar configuration as that previously described for door packaging assembly 100. However, the door assembly packaged in door packaging assembly 200 has differently dimensioned frames and doors. Consequently, to allow the doors 202, 204 to be securely positioned within the stacks 206 of frames 208 similar to that shown and described for assembly 100, the configuration of the doors 202, 204 within door container component 210 is altered.

Door packaging assembly 200 includes a spacer 212 positioned between each stack of doors 202, 204. The spacer 212 in the example show is made of cardboard, but in other examples the spacer 212 can be made of any other material suitable for keeping the doors 202, 204 securely positioned. The spacer 212 of the present embodiment is positioned at or near the middle of each stack of doors 202, 204 and serves to occupy what would otherwise be a void inside of the door container component 210 due to the specific dimensions of the frames 208 and doors 202, 204 in this example. Such a void may be present in the packaging of door assemblies where the frames are closer to a square shape than a rectangular shape. Packaging additional doors 202, 204 to occupy the void could require additional frames 208 to be stacked in the door packaging assembly 200 so as to keep the components of each individual door assembly within the same door packaging assembly 200. This may result in a height of the assembly 200 that prohibits loading onto a trailer. Door assembly 200 can otherwise have some or all of the same features as those described with respect to door assembly 100, and the described altered configuration of the doors 202, 204 still provides for twenty five door assemblies to be included within each assembly 200.

Figure 9A:
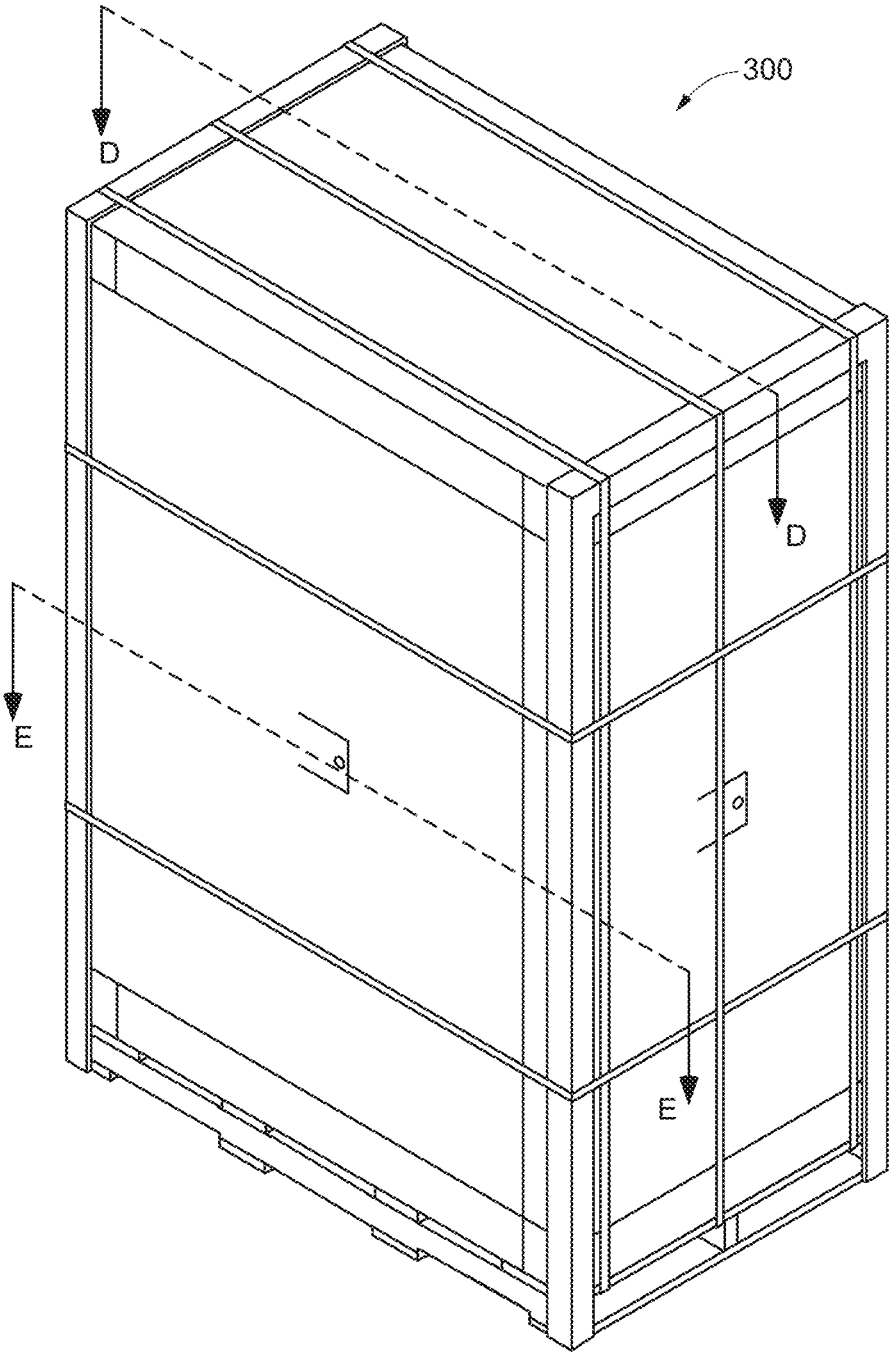
FIG. 9A is a perspective view of a further embodiment of a door packaging assembly.
Figure 9B:
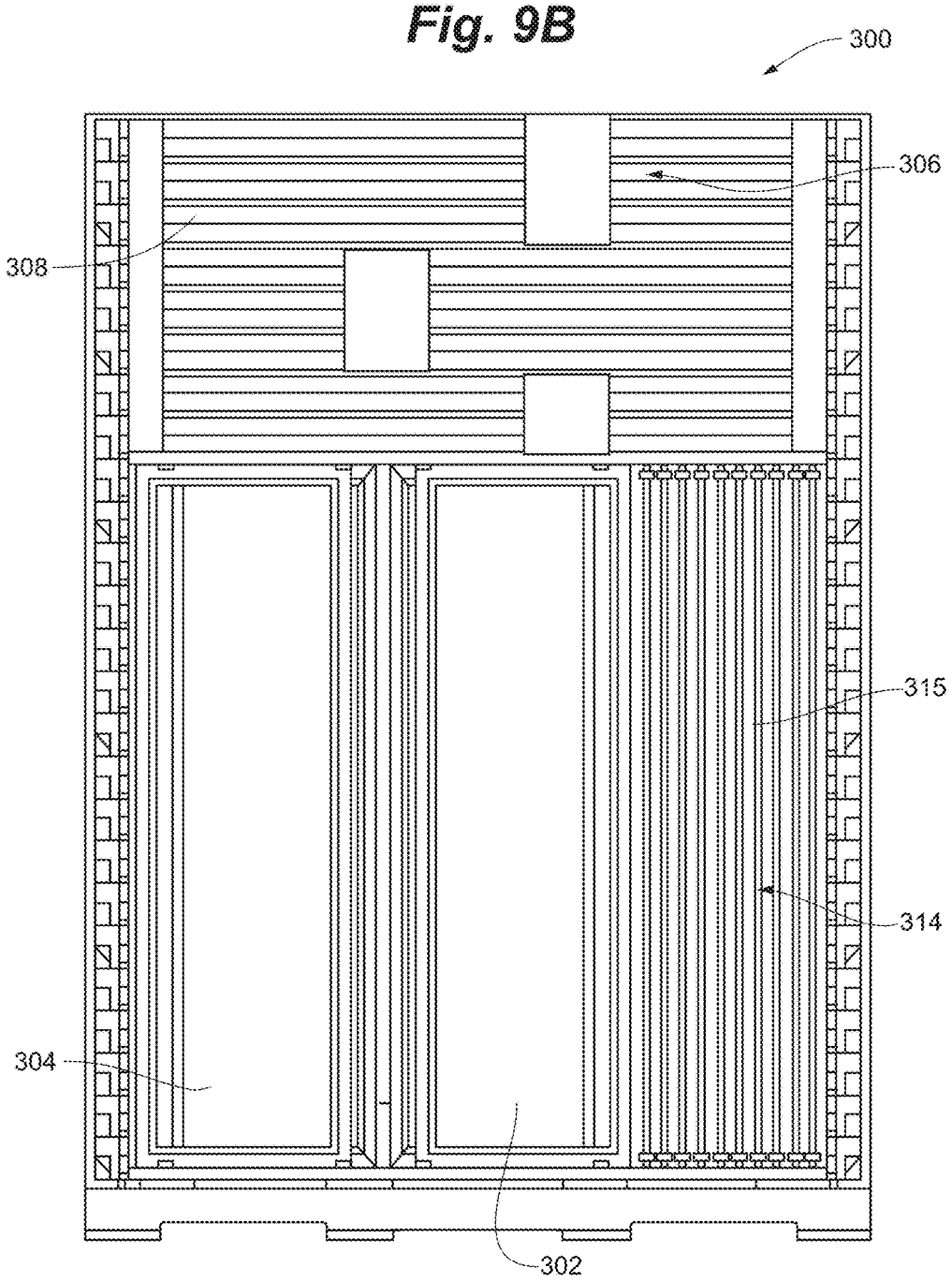
FIG. 9B is a cross-sectional view of the door packaging assembly of FIG. 9A taken along lines D-D of FIG. 9A.
Figure 9C:
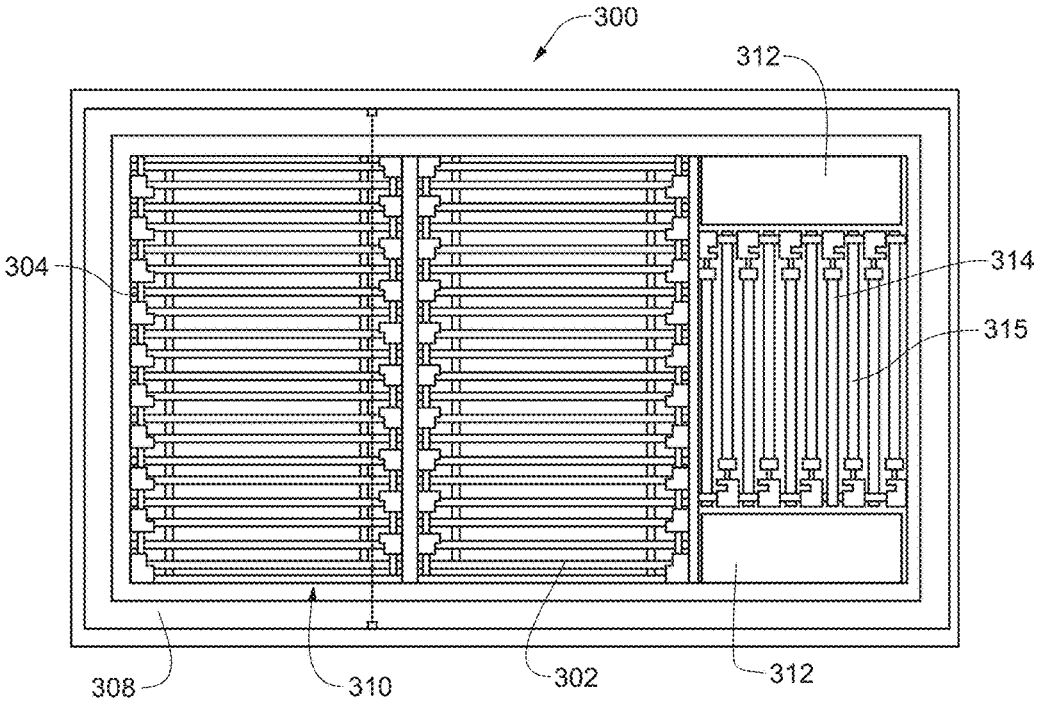
FIG. 9C is a cross-sectional view of the door packaging assembly of FIG. 9A taken along lines E-E of FIG. 9A.

FIGS. 9A-9C show a further embodiment of a door packaging assembly 300. FIG. 9A illustrates a perspective view of the door packaging assembly 300, while FIGS. 9B and 9C illustrate cross-sectional views of the door packaging assembly 300 taken along lines D-D and E-E, respectively, of FIG. 9A.

Door packaging assembly 300 can have a similar configuration as that previously described for door packaging assembly 100. However, the door assembly packaged in door packaging assembly 300 again has differently dimensioned frames and doors. Consequently, to still provide for an increased number of door assemblies able to be loaded onto a trailer (e.g., twenty-five door assemblies per packaging assembly), in the exemplary door packaging assembly 300 the configuration of the doors 302, 304 (within door container component 310) within the stacks 306 of frames 308 is altered.

The specific frame 308 of the door assembly packaged in the door packaging assembly 300 is of a rectangular shape, where a length of each frame 308 is significantly greater than a width of each frame 308. As one example, to securely accommodate the doors 302, 304 within the door container component 310 positioned with the stacks 306 of frames 308 an additional, third stack 314 of doors 315 is configured within the door container component 310. The two stacks of the doors 302, 304 are positioned in a first direction (e.g. in a direction of the width of the frames 308), while the third stack 314 of doors 315 is positioned in a second direction substantially perpendicular to the stacks of the doors 302, 304 (e.g., in a direction of the length of the frames 308). For instance, the first and second stacks of doors 302, 304 may extend parallel to one another, while the third stack of doors 314 extends perpendicular to the first and second stacks of doors 302, 304. As can be seen in both FIGS. 9B and 9C, the doors 302, 304, and 315 are arranged in a staggered relationship. In the illustrated example, two spacers 312 are included on each side of the third stack 314 to fill what would otherwise be a void inside of door container component 310 so as to additionally secure and protect the doors.

The door packaging assembly 300 accounts for the altered shape of the frames 308 while still accommodating, in the present example, twenty-five door assemblies in a single package that can be loaded onto a trailer.

Figure 10A:
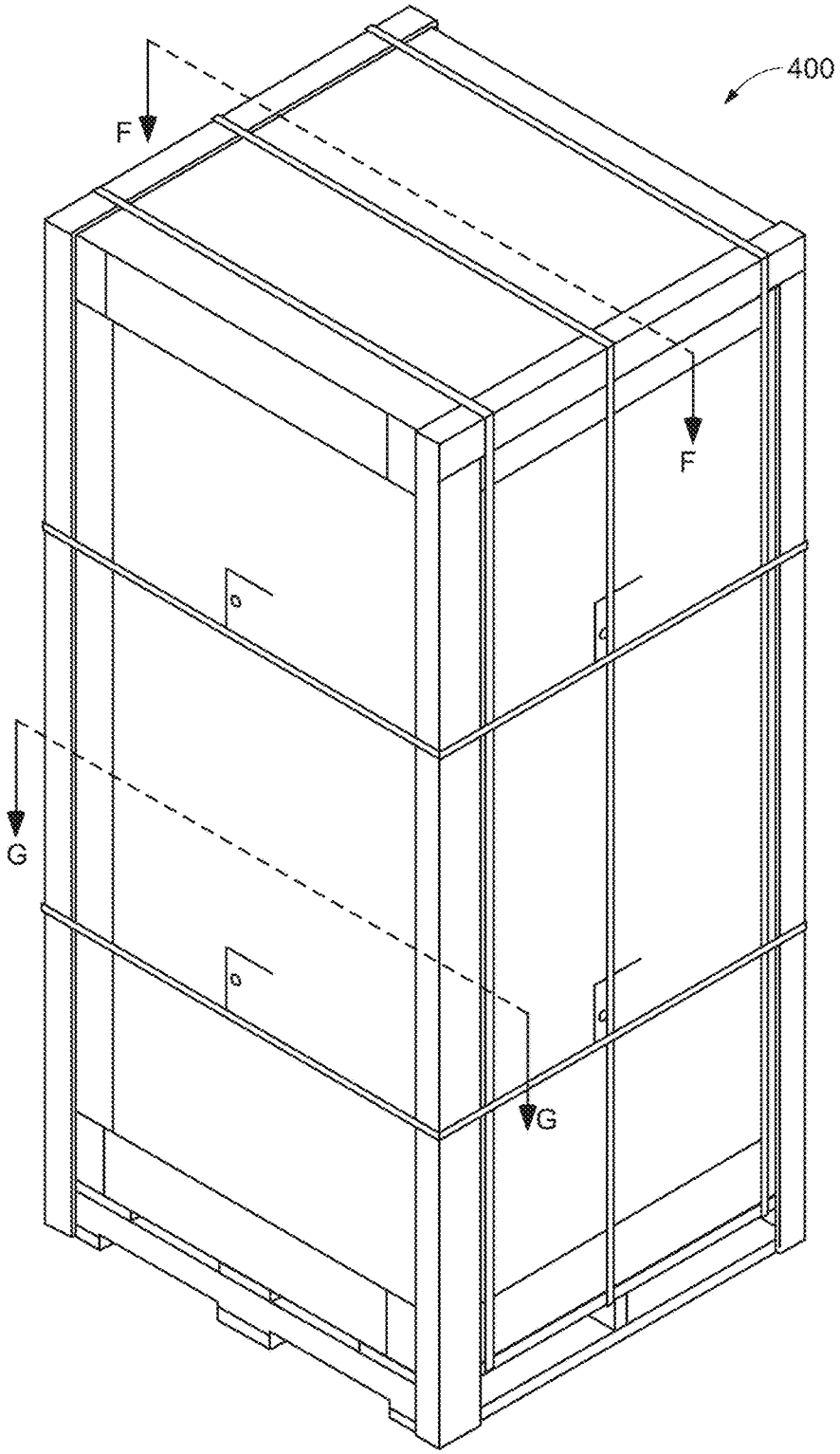
FIG. 10A is a perspective view of an additional embodiment of a door packaging assembly.
Figure 10B:
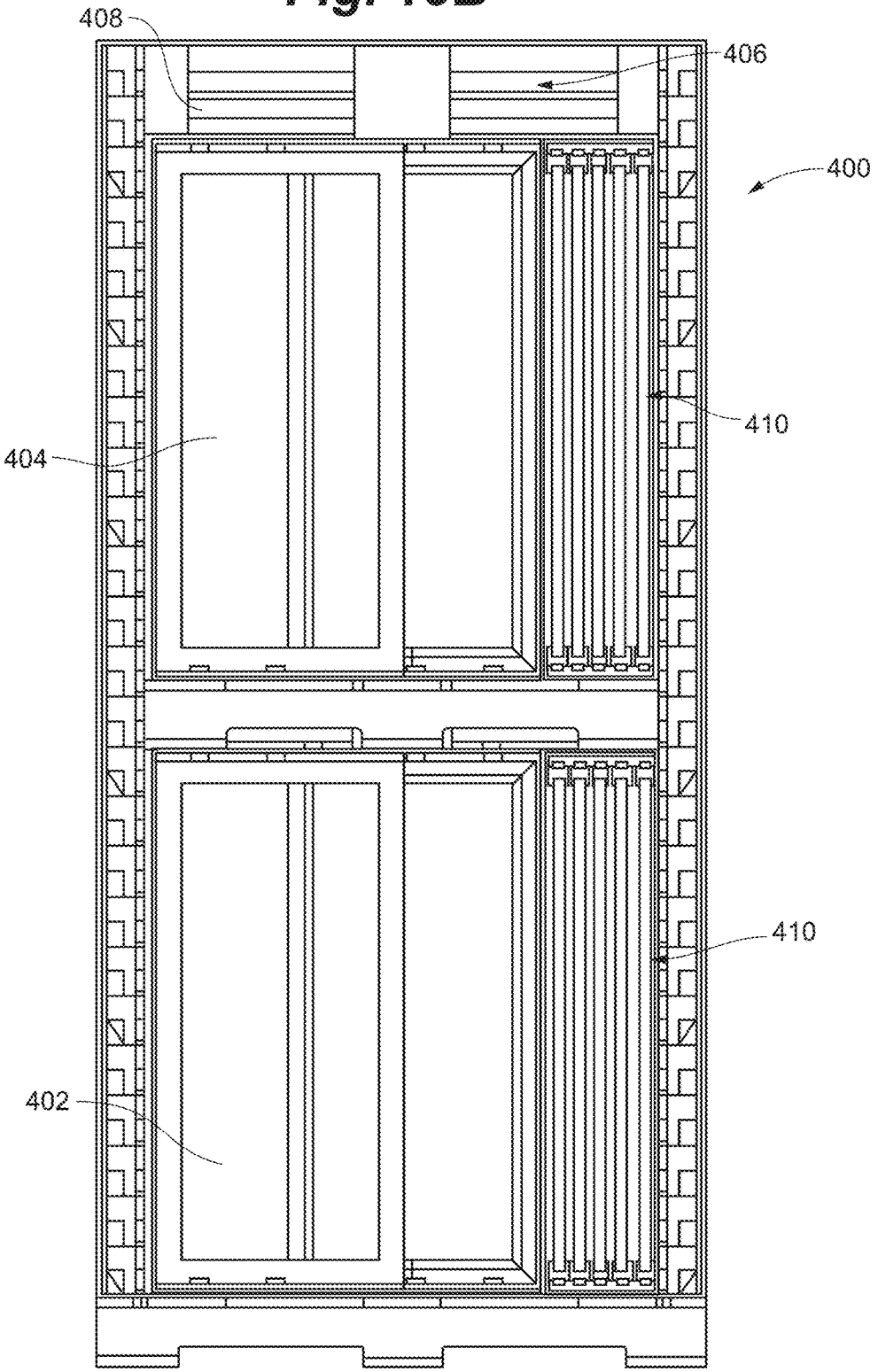
FIG. 10B is a cross-sectional view of the door packaging assembly of FIG. 10A taken along lines F-F of FIG. 10A.
Figure 10C:
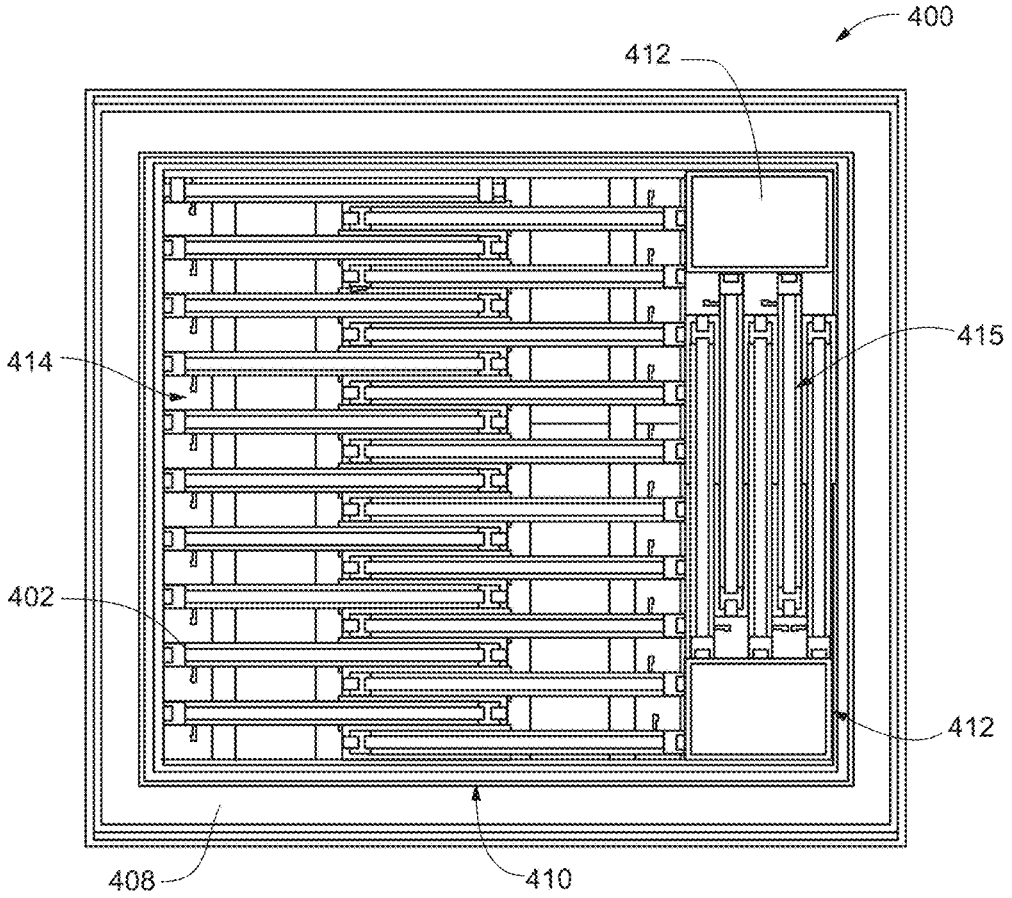
FIG. 10C is a cross-sectional view of the door packaging assembly of FIG. 10A taken along lines G-G of FIG. 10A.

FIGS. 10A-10C show an additional embodiment of a door packaging assembly 400. FIG. 10A illustrates a perspective view of the door packaging assembly 400, while FIGS. 10B and 10C illustrate cross-sectional views of the door packaging assembly 400 taken along lines F-F and G-G, respectively, of FIG. 10A.

Door packaging assembly 400 may have a similar configuration as that previously described for door packaging assembly 100. However, the door assembly packaged in door packaging assembly 400 has differently dimensioned frames and doors. Consequently, to still provide for an increased number of door assemblies able to be loaded onto a trailer (e.g., twenty-five door assemblies per packaging assembly), in the exemplary door packaging assembly 400 the configuration of the doors 402, 404 (within door container component 410) within the stacks 406 of frames 408 is altered.

The particular door assembly frame 408 in the illustrated example is approximately a square shape, where the lengths and widths of the frames 408 are substantially the same. As such, the cross-sectional area inside of the frame stacks 406 for positioning the door container component 410, and thus the doors 402, 404, can be reduced as compared to those door assemblies where the frame has one of the length and width significantly greater than the other. As a result, to accommodate the maximum number of doors 402, 404 within the area defined inside of the frame stacks 406, two door container components 410 are utilized one on top of the other, inside of the frame stacks 406 as shown in the example of FIG. 10B. Each door container component 410 is dimensioned so as to fit within the interior area defined by the frame stacks 406 and can include some or all of the features described previously for the door container components. In one application, the doors 402 (e.g., right doors) can be positioned in one door container component 410, while the door 404 (e.g., left doors) can be positioned on the other door container component 410.

FIG. 10C shows one example of a door configuration within one of the door container components 410. The door container component 410 may have one stack 414 of doors 402 in a first position across, and against an end of, the door container component 410. A second stack 415 of doors 402 can be in a second position substantially perpendicular to the stack 414 and substantially centered with respect to two parallel sides of the door container component 410. One or both stacks 414, 415 can be configured in a staggered relationship, an example of which is seen in FIG. 10C. One or more spacers 412 can be included within the door container component 410 to fill any void remaining in the door container component 410. The additional door container component 410 can be configured similar to the presently described door container component 410.

Embodiments can also include methods of packaging and/or shipping door assemblies. In one example, a plurality of doors are positioned onto a pallet. In addition, a plurality of frames are positioned onto the pallet such that the plurality of doors are positioned within the interior area defined by the plurality of frames. In a further example, the plurality of doors are positioned onto the pallet by loading the plurality of doors into a first door container component, with the plurality of frames positioned around a perimeter of the first door container component at one or more locations along the height of the first door container component. In one embodiment, a second plurality of doors can be loaded into a second door container component which is positioned on top of the first door container component, with the plurality of frames positioned around a perimeter of the first door container component, and in some cases around a perimeter of the second door container component when enough frames are stacked.

In some instances, a tray, such as that described herein, can be positioned onto the pallet as part of various methods, with the first door container component positioned on the tray so as to define a space between a perimeter of the first door container component and the tray. In such instances, one or more frames may be placed around the first door container component, such as by positioning one or more frames within the space between the perimeter of the first door container component and the tray such that one or more frames encompass a perimeter of the first door container component. In some embodiments, additional frames can be added on top of the initially positioned one or more frames. A frame sleeve can be positioned around the frames, and the exterior surface of the door packaging assembly may be securely banded.

Thus, embodiments of the invention are disclosed. Although the present invention has been described with reference to certain disclosed embodiments, the disclosed embodiments are presented for purposes of illustration and not limitation and other embodiments of the invention are possible. One skilled in the art will appreciate that various changes, adaptations, and modifications may be made without departing from the spirit of the invention.

The invention claimed is:

1. A door packaging assembly comprising:

a pallet;

a plurality of frames positioned on the pallet, the plurality of frames defining an interior area;

a first plurality of doors positioned on the pallet and within the interior area defined by the plurality of frames;

a first door container component positioned on the pallet, wherein the first plurality of doors are positioned within the first door container component and comprise a first stack of doors and a second stack of doors spaced from the first stack of doors, wherein each of the first and second stacks of doors is configured within the first door container component in a staggered configuration, and wherein at least some of the plurality of frames surround a perimeter of the first door container component; and a tray positioned on the pallet, the tray including sides radially protruding up from a surface of the tray and defining an interior area of the tray, wherein the first door container component is positioned within the interior area of the tray to define a space between the perimeter of the first door container component and the sides of the tray, and wherein at least one frame of the plurality of frames is positioned in the space between the perimeter of the first door container component and the sides of the tray.

2. The door packaging assembly of claim 1, further comprising:

a second door container component positioned on top of the first door container component, wherein a second plurality of doors are positioned within the second door container component, and wherein at least some of the plurality of frames surround a perimeter of the second door container component.

3. The door packaging assembly of claim 1, further comprising:

a first separator positioned at a space between the first and second stacks of doors; and a first positioning strip spaced from the first separator, the first positioning strip in contact with both the first door container component on a first side of the first positioning strip and one of the first or second stacks of doors on a second side of the first positioning strip, wherein the first side of the first positioning strip is opposite the second side of the first positioning strip.

4. The door packaging assembly of claim 3, wherein the first separator is positioned within the first door container component at a first surface of the first door container component nearest the pallet, and further comprising a second separator positioned within the first door container component at the space between the first and second stacks of doors, wherein the second separator is positioned within the first door container component at a second surface of first door container component opposite the first surface of the first door container component.

5. The door packaging assembly of claim 4, further comprising a second positioning strip spaced from the second separator on the second surface of the first door container component.

6. The door packaging assembly of claim 1, wherein the first stack of doors includes a first door on a first end of the first stack of doors, the first door having a front side including a handle and a back side opposite the front side, and wherein the back side of the first door interfaces with the first door container component and the front side of the first door faces an interior of the first door container component.

7. The door packaging assembly of claim 6, wherein the first stack of doors includes a second door interfacing with the first door, the second door having a front side including a handle and a back side opposite the front side, and wherein the front side of the second door faces the front side of the first door.

8. The door packaging assembly of claim 1, wherein the first and second stacks of doors extend parallel to one another, and further comprising a third stack of doors extending perpendicular to both the first and second stacks of doors within the first door container component.

9. The door packaging assembly of claim 1, further comprising a banding secured around the first door container component.

10. The door packaging assembly of claim 9, wherein the banding is secured around the first door container component in a plane perpendicular to the pallet.

11. The door packaging assembly of claim 10, wherein the banding passes through at least a top surface of the pallet to secure the first door container component to the pallet.

12. A door packaging assembly comprising:

a pallet;

a plurality of frames positioned on the pallet, including a first frame, a second frame stacked on the first frame, and a third frame stacked on the second frame, wherein each of the first frame, the second frame, and the third frame defines an interior area that extends parallel to the pallet wherein the first, second, and third frames are secured together; and a first plurality of doors positioned on the pallet within the interior area, wherein at least one door of the first plurality of doors lies in a first plane that extends transverse to the interior area, wherein each of the first frame, the second frame, and the third frame surrounds a periphery of the first plurality of doors, and wherein each of the first frame, the second frame, and the third frame is configured to fittingly support at least one door of the first plurality of doors when assembled.

13. The door packaging assembly of claim 12, wherein the first plurality of doors lie in, or are positioned parallel to, the first plane.

14. The door packaging assembly of claim 12, wherein the first plane extends perpendicular to the interior area of each of the first frame, the second frame, and the third frame.

15. The door packaging assembly of claim 12, wherein the interior area of each of the first frame, the second frame, and the third frame lies in, or is parallel to, a second plane, and wherein the first plane is perpendicular to the second plane.

16. The door packaging assembly of claim 12, further comprising:

a first door container component positioned on the pallet, wherein the first plurality of doors are positioned within the first door container component, and wherein at least some of the plurality of frames surround a perimeter of the first door container component.

17. The door packaging assembly of claim 16, further comprising:

tray positioned on the pallet, the tray including sides radially protruding up from a surface of the tray and defining an interior area of the tray, wherein the first door container component is positioned within the interior area of the tray to define a space between the perimeter of the first door container component and the sides of the tray, and wherein at least the first frame of the plurality of frames is positioned in the space between the perimeter of the first door container component and the sides of the tray.

18. The door packaging assembly of claim 12, further comprising:

a separator, wherein the first plurality of doors are stacked on each side of the separator in a staggered configuration.

19. A door packaging assembly comprising:

a first frame defining a first interior area;

a second frame stacked onto the first frame, the second frame defining a second interior area that is spaced from the first interior area;

a third frame stacked onto the second frame, the third frame defining a third interior area that is spaced from the first interior area and the second interior area; and a door positioned within the first interior area, the second interior area, and the third interior area such that the door extends through the first frame, the second frame, and the third frame, wherein each of the first frame, the second frame, and the third frame surrounds a periphery of the door, and wherein at least one of the first frame, the second frame, and the third frame is configured to fittingly support the door when assembled and wherein the door extends out beyond the second frame and the third frame.

20. The door packaging assembly of claim 19, wherein the second frame is stacked onto the first frame and the third frame is stacked onto the second frame along a first axis, wherein the door extends through the first frame, the second frame, and the third frame along a second axis that is parallel to the first axis.

* * * * *